US006094970A

United States Patent [19]

Sprenger et al.

[11] Patent Number: 6,094,970

[45] Date of Patent: Aug. 1, 2000

[54] LEAK DETECTOR FOR A PUMP

[75] Inventors: Henry K. Sprenger, Huntingdon Valley; Walter P. Telly, Perkasie; Joel E. Higbee, Doylestown, all of Pa.

[73] Assignee: Milton Roy Company, Ivyland, Pa.

[21] Appl. No.: 09/211,839

[22] Filed: Dec. 15, 1998

[51] Int. Cl.[7] ..... F04B 21/00; F04B 43/06; G01M 3/28

[52] U.S. Cl. ..... 73/40; 73/46; 73/49.8; 417/9; 417/63

[58] Field of Search ..... 73/40, 49.8, 46; 417/63, 9

[56] References Cited

U.S. PATENT DOCUMENTS

| | | | |
|---|---|---|---|
| 2,662,478 | 12/1953 | Surre | 103/44 |
| 2,770,779 | 11/1956 | Horn | 340/242 |
| 3,131,638 | 5/1964 | Wilson et al. | 103/44 |
| 3,605,566 | 9/1971 | Vetter | 92/5 |
| 4,382,379 | 5/1983 | Kelly | 73/46 |
| 4,393,674 | 7/1983 | Rasmussen | 72/61 |
| 4,407,171 | 10/1983 | Hasha et al. | 73/46 |
| 4,420,970 | 12/1983 | Organi et al. | 73/46 |
| 4,432,227 | 2/1984 | Dunn et al. | 73/49.8 |
| 4,462,422 | 7/1984 | Owoc et al. | 137/557 |
| 4,573,343 | 3/1986 | Huiber | 73/40 |
| 4,781,535 | 11/1988 | Frawley et al. | 417/53 |
| 4,881,876 | 11/1989 | Laziou | 417/63 |
| 4,888,979 | 12/1989 | Steeper | 73/40.7 |
| 4,971,523 | 11/1990 | Wacker et al. | 417/63 |
| 5,170,659 | 12/1992 | Kemp | 73/46 |
| 5,195,361 | 3/1993 | Wood et al. | 73/49.8 |
| 5,330,720 | 7/1994 | Sorbo et al. | 422/98 |
| 5,383,351 | 1/1995 | Kotlyar | 73/40 |
| 5,610,324 | 3/1997 | Lawson | 73/46 |
| 5,647,733 | 7/1997 | Augustyn et al. | 417/360 |
| 5,834,631 | 11/1998 | Yamaguti et al. | 73/40 |

OTHER PUBLICATIONS

Product Brochure entitled: "Milton Roy Metering Pump Technology", Bulletin 210, dated Jul. 1998.

*Primary Examiner*—Hezron Williams
*Assistant Examiner*—J. David Wiggins
*Attorney, Agent, or Firm*—Marshall O'Toole Gerstein Murray & Borun

[57] ABSTRACT

A leak detector for a pump having a plurality of stacked diaphragms includes a plurality of flat spacer rings each having discontinuous channels and being disposed in face-to-face abutting and stacked relationship with one another wherein the discontinuous channels of the spacer rings together form tortuous leak paths extending through the flat spacer rings from working areas of the pump to a point outside of sealing areas thereof. A port is disposed in fluid communication with the port and an apparatus is provided for developing a visual indication of fluid in the port. A circumferential fluid-tight seal is disposed radially outside of the port for sealing off fluid loss beyond the outer periphery of the plurality of diaphragms and flat spacer rings.

19 Claims, 5 Drawing Sheets

FIG. 6
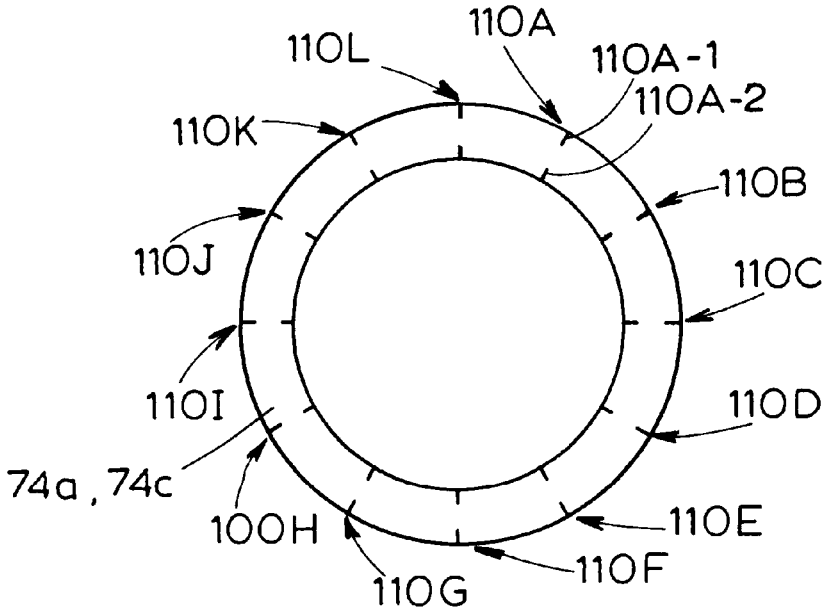
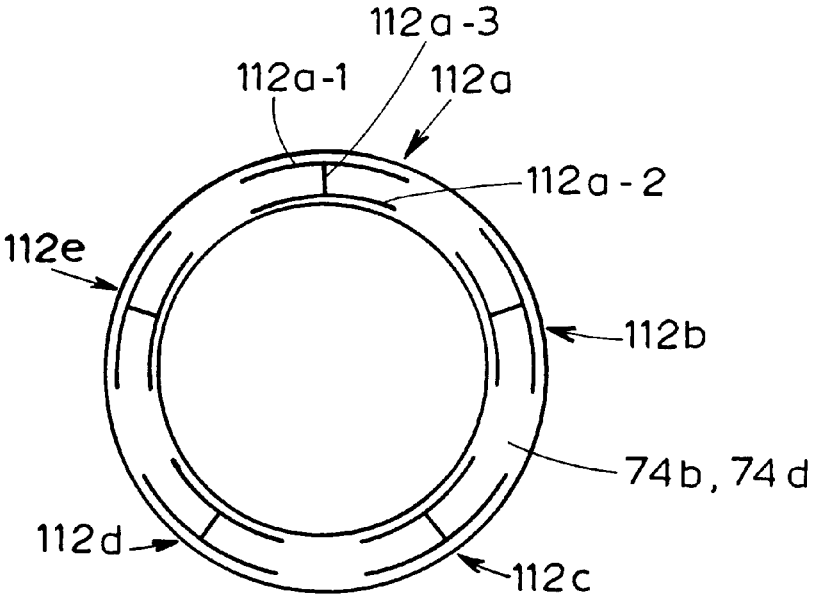
FIG. 7

LEAK DETECTOR FOR A PUMP

FIELD OF THE INVENTION

The present invention relates generally to pumping devices, and more particularly to a leak detector for a diaphragm-type pump.

BACKGROUND OF THE INVENTION

Diaphragm metering pumps frequently are used to dose, inject or transfer hazardous or corrosive fluids into a process stream. In the event of a failure in the diaphragm seal area, these fluids, or pump hydraulic oil, may contaminate the immediate environment. Conversely, in the case of a diaphragm failure due to fatigue in the diaphragm working area (as opposed to the radially outer seal area), a process may be ruined due to hydraulic oil being injected into the process stream. Alternatively, a corrosive fluid may be drawn into the metering pump, thereby causing severe corrosion damage. One partial solution to this problem is to provide a double or triple diaphragm construction. In one such pump, spaces between the diaphragms are filled with an inert fluid which transmits the fluid pressure from the working fluid to the process fluid. In a second type of pump, the diaphragms are positioned closely together and a thin film of lubricant may be provided in the space between the diaphragms. While these constructions reduces the incidence of diaphragm failure, leaks still can occur and hence the ability to detect a diaphragm failure due to either seal area breakdown or working area fatigue failure is considered of prime importance in many industries. In the fluid-filled intermediate chamber type of pump described above, this may be accomplished by sensing a change in conductivity of the intermediate fluid. In the second type of pump, leakage detection is achieved by sensing leakage of working or process fluid into a leakage port. An example of the latter is shown in FIGS. 1 and 2, which illustrate a prior art double diaphragm metering pump having first and second diaphragms 10, 12 separated by a fluid-filled space 14. A hollow annular ring 16 is located at a seal region 18 of the diaphragms 10, 12 and the hollow ring 16 and the diaphragms 10, 12 are clamped between a diaphragm head 20 and a member 22 defining a displacement chamber (not shown). A recess 24 in the hollow member 16 is in fluid communication with a hollow tube 26, which in turn is connected in fluid communication with a pressure gauge 28 (FIG. 1).

As can be seen by an inspection of FIG. 2, there is a roughly triangular space 30 located just radially inward from the radially innermost part of the hollow member 16. This space 30 results from the clamping of the diaphragms 10, 12 by first and second shim pads 32, 34 against a tip 36 of the hollow member 16. The space 30 can trap air which can interfere with the ability of the diaphragms to operate as a unit. Also, high stresses due to clamping of the diaphragms just below the space 30 can lead to fatigue failure.

FIG. 3 illustrates a further prior art pump 40 wherein first and second diaphragms 42, 44 are separated at a radially outermost portion by a machined ring 46. The diaphragms 42, 44 and the machined ring 46 are clamped between members 48, 50 and 52. An O-ring 54 provides sealing between the members 48, 50. A duct 53 is placed in fluid communication with a pressure gauge or pressure switch (not shown) to indicate when a leak has occurred which causes either working fluid or process fluid under pressure to enter the space between the diaphragms 42, 44. While the machined ring 46 minimizes the volume of trapped air between the diaphragms 42, 44, it has been found that this design can only be operated at pressures below the rated pressure of the pump 40 owing to the diaphragm design.

SUMMARY OF THE INVENTION

According to one aspect of the present invention, a leak detector for a pump having a plurality of diaphragms includes a plurality of flat spacer rings each having discontinuous channels and being disposed in side-by-side abutting relationship with one another and clamped between sealing areas of the diaphragms. The discontinuous channels of the spacer rings together form tortuous leak paths extending from the working areas to a point outside of the sealing areas. A port is disposed in fluid communication with the point and means provide a visual indication of fluid in the port. In addition, a seal is disposed radially outside of the port.

Preferably, the providing means comprises a pressure gauge, a pressure switch or a visual device.

Also preferably, the spacer rings are of first and second types wherein each spacer ring of the first type has a first arrangement of channels and each spacer ring of the second type has a second arrangement of channels different than the first arrangement of channels. Still further in accordance with the preferred embodiment, the first arrangement of channels comprises radially directed channels and the second arrangement of channels comprises radially directed and circumferentially directed channels. Still further, the channels may extend fully through the spacer rings.

In the preferred embodiment, a spacer shim is disposed radially outside the seal. Also, the seal may bear against a first side of the spacer shim and an additional seal may also be included which bears against the second side of the spacer shim opposite the first side.

Further in accordance with the preferred embodiment, four spacer rings are provided.

In accordance with a further aspect of the present invention, a leak detector for a pump having a pair of diaphragms disposed between a diaphragm head and a wall of a structure defining a displacement chamber includes a plurality of flat spacer rings each having discontinuous channels and being disposed in side-by-side abutting relationship with one another. The flat spacer rings are clamped with sealing areas of the diaphragms between the diaphragm head and the wall of the structure defining the displacement chamber. The discontinuous channels of the spacer rings together form tortuous leak paths extending from a working area to a point outside of the sealing areas. A spacer shim is disposed radially outside the spacer rings and a seal is disposed radially outside of the point in sealing contact with the spacer shim. A port is provided in fluid communication with the point and means provide a visual indication of fluid in the port caused by leakage of one or both of the diaphragms.

Other aspects and advantages of the present invention will become apparent upon consideration of the following drawings and detailed description of the preferred embodiments.

BRIEF DESCRIPTION OF THE DRAWINGS

FIGS. 6 and 7 are elevational views of two types of sealing rings used in the pump illustrated in FIGS. 4 and 5.

DETAILED DESCRIPTION OF THE PREFERRED EMBODIMENT

Figure 1:
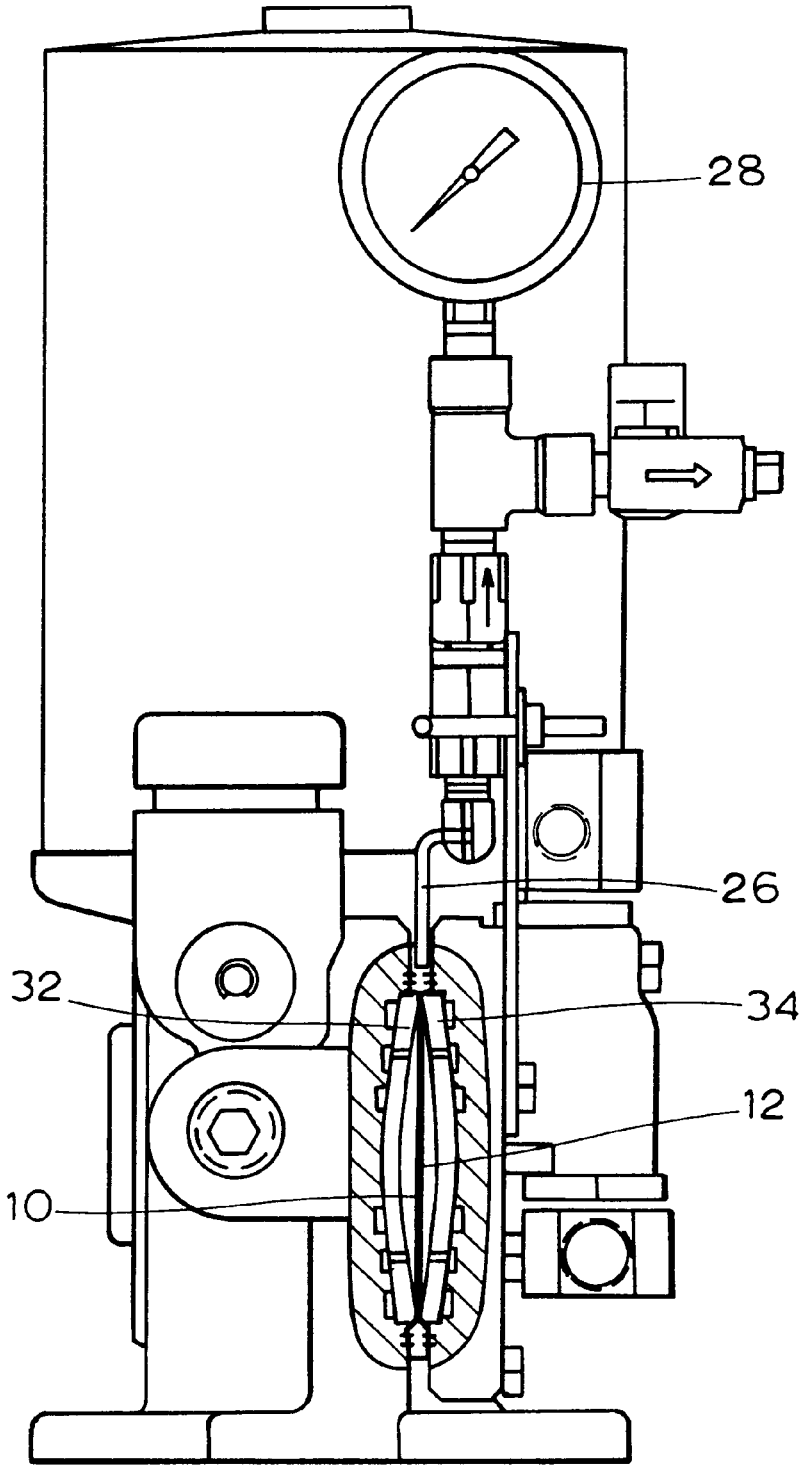
FIG. 1 PRIOR ART
FIG. 1 comprises an elevational view, partly in section, of a prior art metering pump.
Figure 2:
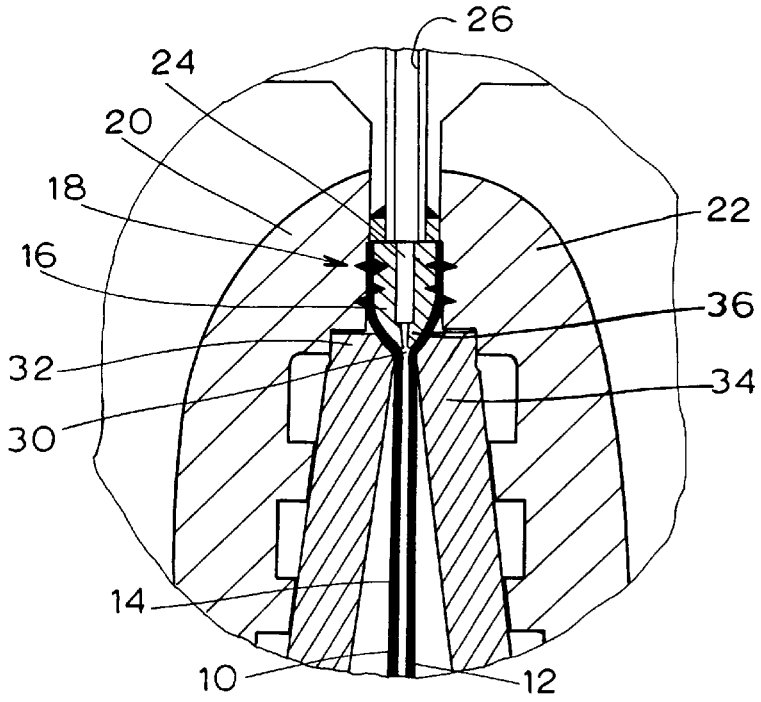
FIG. 2 PRIOR ART
FIG. 2 is an exploded, fragmentary sectional view of the prior art pump of FIG. 1.
Figure 3:
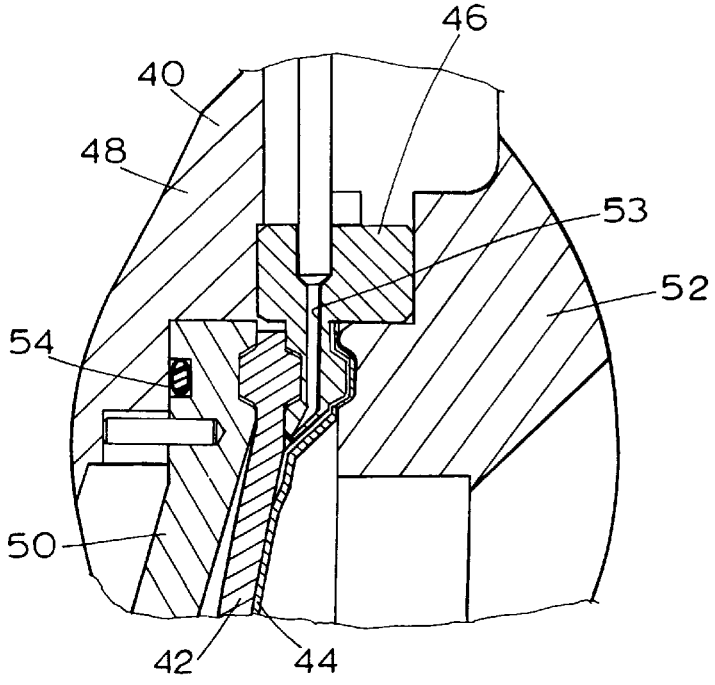
FIG. 3 PRIOR ART
FIG. 3 is a view similar to FIG. 2 of a portion of a further prior art metering pump.
Figure 4:
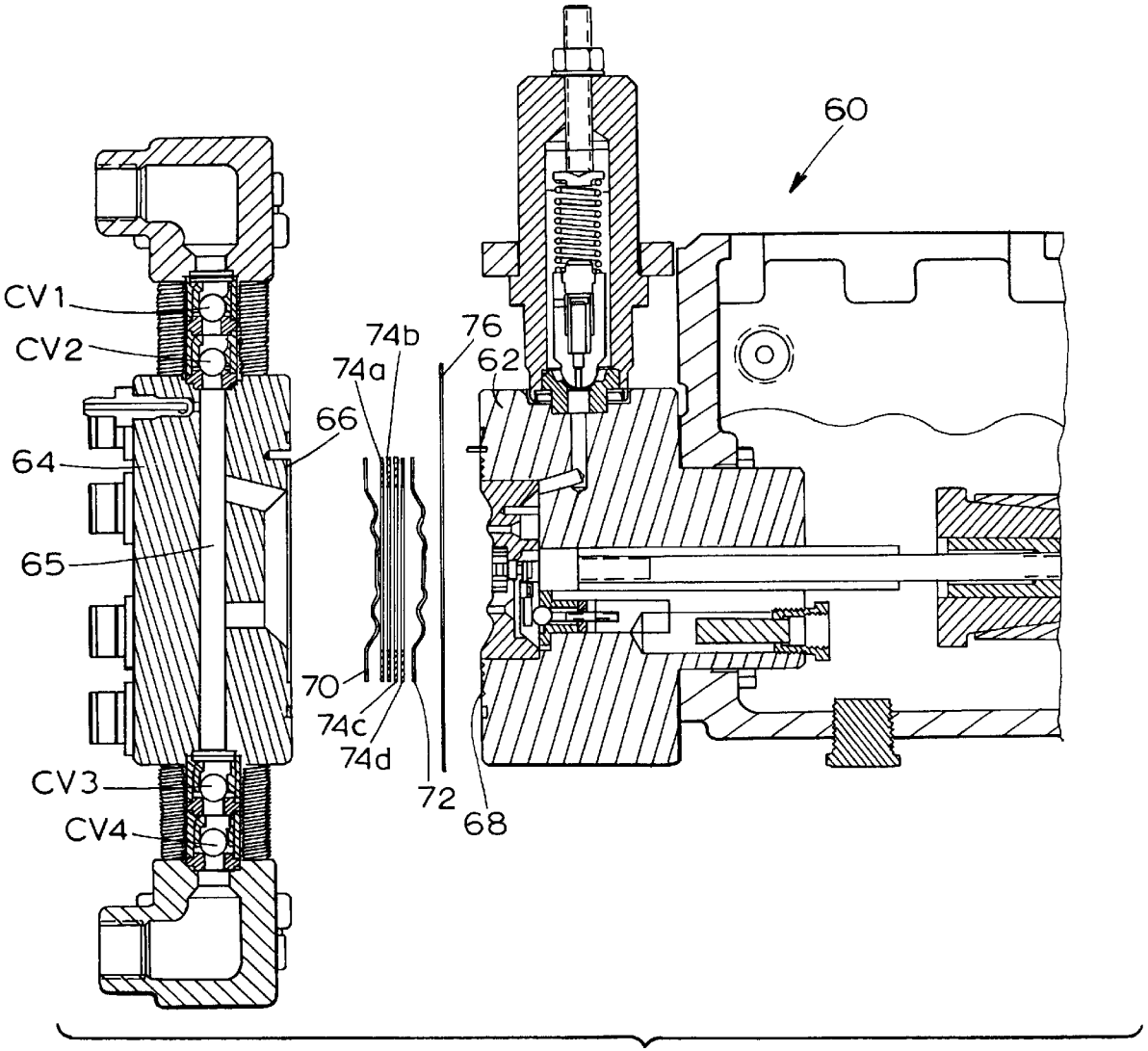
FIG. 4 is an exploded, sectional view of a pump incorporating the present invention.
Figure 5:
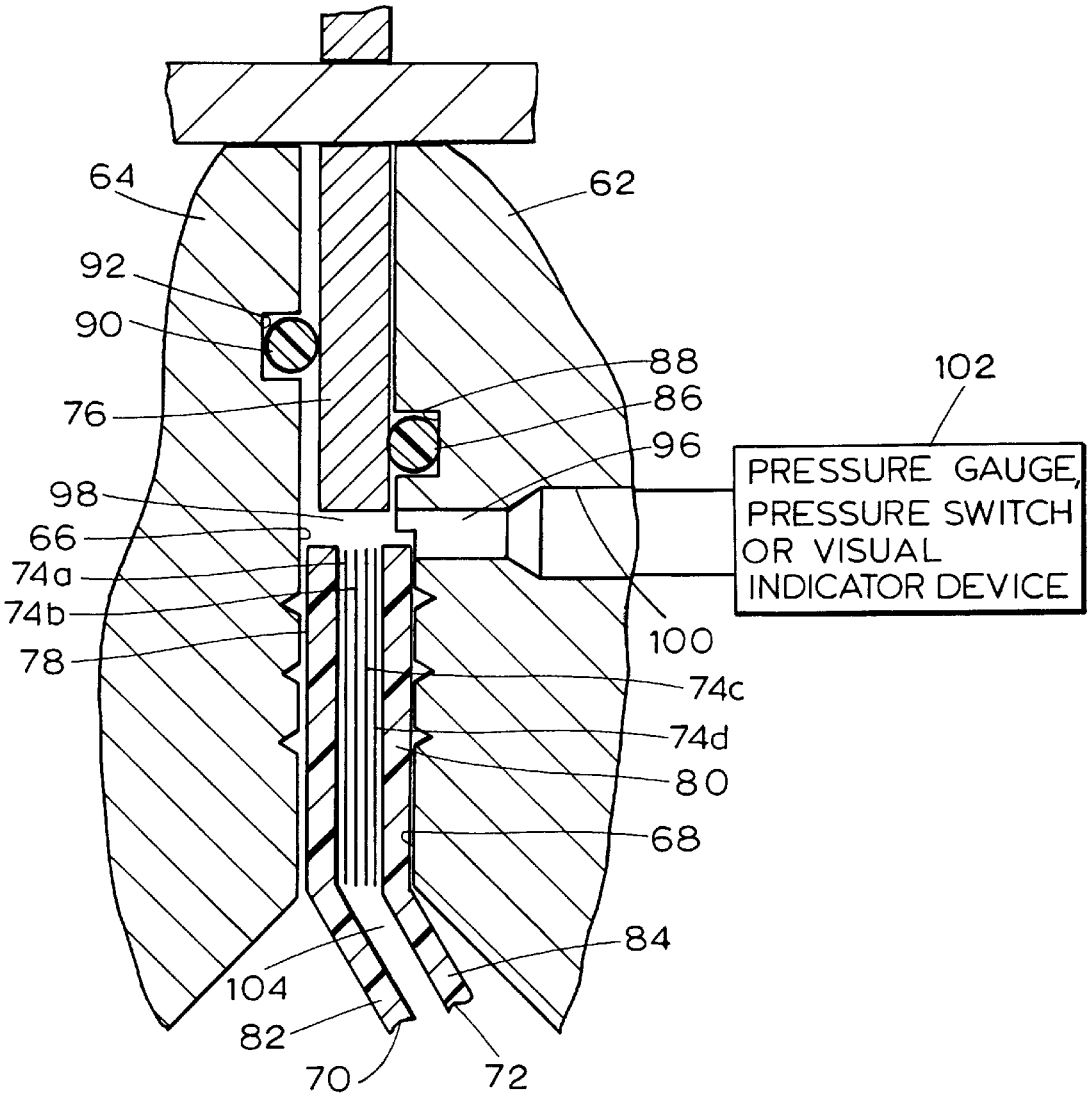
FIG. 5 is an exploded, fragmentary, sectional view of the pump of FIG. 4 shown in an assembled condition.

A metering pump 60 incorporating the present invention is illustrated in FIGS. 4 and 5. The pump 60 includes a diaphragm head 62 and a liquid end 64 which is bolted or otherwise secured to the diaphragm head 62 by any suitable fasteners (not shown). The liquid end 64 defines a displacement or process chamber 65 into which a process fluid is caused to flow through check valves CV1–CV4. Secured between a wall 66 of the liquid end 64 and a wall 68 of the diaphragm head 62 are first and second diaphragms 70, 72, a plurality of flat seal or spacer rings 74*a*–74*d* and a spacer shim 76. Normally, no fluid is present in the space between the diaphragms 70, 72, with the exception of a very thin film of lubricant, such as mineral oil, to prevent scuffing of the diaphragm faces. With specific reference to FIG. 5, the spacer shim 76 is located radially outside the diaphragms 70, 72 and the spacer rings 74. In addition, sealing areas 78, 80 of the diaphragms 70, 72 located radially outwardly from working areas 82, 84 of the diaphragms 70, 72, are clamped together with the spacer rings 74*a*–74*d* in side-by-side relationship between the walls 66,68.

A first seal in the form of an O-ring 86 is disposed in a recess 88 in the diaphragm head 62 and bears against the spacer shim 76. A second seal in the form of a further O-ring 90 is disposed in a recess 92 in the liquid end 64 and bears against a second side of the spacer shim 76 opposite the first side. A fluid port 96 extends from a point 98 between the radially innermost extent of the spacer shim 76 and the radially outermost extents of the sealing areas 78, 80 and the spacer rings 74*a*–74*d*. The port 96 terminates in a threaded bore 100. A visual indication means in the form of a pressure gauge or a pressure switch 102 may be placed in fluid communication with the port 100. Alternatively, a visual device, such as a sight glass or a simple visual indicator which is actuated when pressured fluid is delivered to the port 100 caused by leakage of one of the diaphragms 70, 72 may be provided.

Preferably, each diaphragm 70, 72 is fabricated of a PTFE resin, although a different diaphragm material could alternatively be used. In addition, an inert fluid may be provided in a space 104 between the diaphragms 70, 72 to assist in operating the diaphragms together as a unit.

FIGS. 6 and 7 illustrate the spacer or seal rings 74*a*–74*d* in greater detail. The seal rings 74*a*–74*d* are of two types wherein the seal rings 74*a* and 74*c* are of the type illustrated in FIG. 6 and the seal rings 74*b* and 74*d* are of the type illustrated in FIG. 7. Referring first to FIG. 6, each seal ring 74*a*, 74*c* includes a plurality of sets of discontinuous channels 110A*a*–110L. Each set 110A–110L includes a pair of spaced channels, for example the channels 110A-1 and 110A-2, which are aligned in the sense that they are disposed on a common radial line. The sets 110A–110L are disposed at 30 degree spacing increments about each of the sealing rings 74*a*, 74*c*. Preferably, although not necessarily, each of the channels of the sets 110A–110L extends fully through the spacer rings 74*a*, 74*c*.

As seen in FIG. 7, each spacer ring 74*b*, 74*d* includes a plurality of sets of discontinuous channels 112A–112E. Inasmuch as the sets 112A–112E are identical, only the set 112A will be described in detail. The set 112A includes first and second circumferentially directed channels 112A-1 and 112A-2 which preferably have substantially equal angular extents. A radially directed channel 112A-3 interconnects the circumferentially directed channels 112A-1 and 112A-2. As with the spacer rings 74*a*, 74*c*, the channels of the spacer rings 74*b*, 74*d* preferably, although not necessarily, extend fully through the spacer rings 74*b*, 74*d*. The positions of the sets 110A–110L and the sets 112A–112E, the angular extents of the circumferential channels of the sets 112A–112E and the lengths of the channels 110A–110L are selected so that tortuous leak paths are established from points located inside the radially innermost edges of the seal rings 74*a*, 74*d* to points located outside the radially outermost edges of the seal rings 74*a*–74*d*, regardless of the angular positions of the rings 74*a*–74*d* relative to one another. For example, a leak path may be established from the channel 110A-2 of the seal ring 74*c* to the circumferential channel 112A-2 and thence through the radial channel 112A-3, the circumferential channel 112A-1, the channel 110A-1 of the seal ring 74*c* to the point 98. Of course, depending upon the angular orientations of the rings 74*a*, 74*d*, different tortuous leak paths will be established. In any event, when a rupture of either or both of the diaphragms 70,72 occurs, either working fluid in the form of hydraulic oil or process fluid flows to the space inside of the ring 74*a*–74*d*. This fluid is under pressure and escapes through the tortuous leak paths to the point 98, whereupon an indication of the leakage is developed by the visual indication means 102.

If desired, a different number of seal rings 74 may be used. It should be noted, however, that, owing to the possibility of cold extrusion or flowing of the material of the diaphragms 70, 72 into the axially outermost channels of the seal ring 74*a*, 74*d*, it may be necessary to provide a minimum of three or four spacer rings 74. If cold extrusion of the diaphragm material into the channels of the axially outermost seal rings 74 can be avoided, then it may be possible to use a minimum of two such rings rather than a minimum of a greater number of rings.

In addition to the foregoing, it should be noted that the channel configurations and the numbers of channels may be varied, as desired, and still obtain the tortuous leak paths. By way of example only, each seal ring 74*a*–74*d* may have a thickness of 0.008 inch whereas the channels 110 and 112 may have a width of 0.010 inch. The angular extent of each of the circumferential channels of the seal rings 74*b*, 74*d* (as exemplified by the circumferential channels 112A-1 and 112A-2) may be approximately 48 degrees and the radial channels of the seal rings 74*b*, 74*d* (as exemplified by the radial channel 112A-3) may be equally spaced about the circumference of the seal rings 74*b*–74*d* and may be substantially centered with respect to the circumferential channels associated therewith. Further, the distance between the outer periphery of each seal ring 74*b*, 74*d* and each radially outermost circumferential channel may be approximately 0.100 inch whereas the distance between the radially innermost periphery of each seal ring 74*b*, 74*d* and the radially innermost circumferential channel may be approximately 0.085 inch. Also, each of the rings 74*a*–74*d* may have a radial dimension of 0.924 inches and the length of each of the radially outermost channels of the sets 110A–110L may be approximately equal to 0.165 inch whereas the length of each of the radially innermost channels of the sets 110A–110L may be substantially equal to 0.115 inch.

It should be noted that the foregoing dimensions may be different for a different size pump and still obtain the benefits of the present invention. In addition, the spacer rings 74*a*–74*d* are preferably fabricated utilizing a photochemical machining process, although a different manufacturing process may instead be used.

The rings 74 are sufficiently thin to prevent substantial stresses from being imparted to the diaphragms at one point just radially inside the rings. Premature fatigue may therefore be avoided.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

The invention claimed is:

1. A leak detector for a pump having a plurality of stacked diaphragms, each diaphragm having an annular sealing area disposed radially outside of a working area, comprising:

a plurality of flat spacer rings each having discontinuous channels and opposed faces and being disposed in face-to-face abutting and stacked relationship with one another and clamped between the sealing areas of the diaphragms, the discontinuous channels of the spacer rings together forming tortuous leak paths extending through the flat spacer rings from the working areas to a point outside of the sealing areas;

a port disposed at or outside of the point, which port is in fluid communication with the point;

means for providing a leakage warning via a visual indication of fluid in the port; and a circumferential fluid-tight seal disposed radially outside of the port and sealing off fluid loss beyond the outer periphery of the plurality of diaphragms and flat spacer rings.

2. The leak detector of claim 1, wherein the leakage warning providing means comprises a pressure gauge.

3. The leak detector of claim 1, wherein the leakage warning providing means comprises a pressure switch.

4. The leak detector of claim 1, wherein the leakage warning providing means comprises a visual indicator device.

5. The leak detector of claim 1, wherein the spacer rings are of first and second types wherein each spacer ring of the first type has a first arrangement of channels and each spacer ring of the second type has a second arrangement of channels different than the first arrangement of channels.

6. The leak detector of claim 5, wherein the first arrangement of channels comprises radially directed channels and the second arrangement of channels comprises radially directed and circumferentially directed channels.

7. The leak detector of claim 1, wherein the channels extend fully through the spacer rings.

8. The leak detector of claim 1, further including a spacer shim separating a diaphragm head from a liquid end of the pump, wherein the spacer shim is disposed radially outside the seal.

9. The leak detector of claim 8, wherein the seal bears against a first side of the spacer shim and further including an additional seal which provides fluid containment and which bears against a second side of the spacer shim opposite the first side.

10. The leak detector of claim 1, including four spacer rings.

11. A leak detector for a pump having a pair of stacked diaphragms disposed between a diaphragm head and a wall of a structure defining a displacement chamber, each diaphragm having an annular sealing area disposed radially outside of a working area, comprising:

a plurality of flat spacer rings each having opposed faces a discontinuous channels and being disposed in face-to-face abutting relationship with one another and clamped with the sealing areas of the diaphragms between the diaphragm head and the wall of the structure, the discontinuous channels of the spacer rings together forming tortuous leak paths extending through the flat spacer rings from the working areas to a point outside of the sealing areas;

a spacer shim disposed radially outside the spacer rings and separating a diaphragm head from a liquid end of the pump;

a circumferential fluid-tight seal disposed radially outside of the point in sealing contact with the spacer shim and sealing off liquid loss beyond the outer periphery of the pair of diaphragms and the plurality of flat spacer rings;

a port disposed at or outside the point, which port is in fluid communication with the point; and means for providing a leakage warning via a visual indication of fluid in the port caused by leakage of one or both of the diaphragms.

12. The leak detector of claim 11, wherein the leakage warning providing means comprises a pressure gauge.

13. The leak detector of claim 11, wherein the leakage warning providing means comprises a pressure switch.

14. The leak detector of claim 11, wherein the leakage warning providing means comprises a visual indicator device.

15. The leak detector of claim 11, wherein the spacer rings are of first and second types wherein each spacer ring of the first type has a first arrangement of channels and each spacer ring of the second type has a second arrangement of channels different than the first arrangement of channels.

16. The leak detector of claim 15, wherein the first arrangement of channels comprises radially directed channels and the second arrangement of channels comprises radially directed and circumferentially directed channels.

17. The leak detector of claim 16, wherein the channels extend fully through the spacer rings.

18. The leak detector of claim 17, wherein the seal bears against a first side of the spacer shim and further including an additional seal which provides fluid containment and which bears against a second side of the spacer shim opposite the first side.

19. The leak detector of claim 18, wherein there are four spacer rings arranged in a stack, two of which are of the first type and two of which are of the second type and wherein the spacer rings of the first type alternate with spacer rings of the second type in the stack.

* * * * *